US006543190B2

(12) United States Patent
Hitch

(10) Patent No.: US 6,543,190 B2
(45) Date of Patent: Apr. 8, 2003

(54) PORTABLE WEIGHT STRIP FOR ADJUSTABLY HOLDING A MEMBER IN POSITION ON AN UNEVEN SURFACE; AND METHOD

(76) Inventor: Robert W. Hitch, P.O. Box 4205, Ventura, CA (US) 93007

( * ) Notice: Subject to any disclaimer, the term of this patent is extended or adjusted under 35 U.S.C. 154(b) by 0 days.

(21) Appl. No.: 09/839,665

(22) Filed: Apr. 23, 2001

(65) Prior Publication Data

US 2001/0048848 A1 Dec. 6, 2001

Related U.S. Application Data

(60) Provisional application No. 60/208,000, filed on May 26, 2000.

(51) Int. Cl.[7] ..... E01C 9/00

(52) U.S. Cl. ..... 52/177; 52/669; 52/5; 404/35; 404/36; 404/37; 405/15; 405/19; 405/20; 405/212

(58) Field of Search ..... 405/35, 19, 20, 405/212, 302.6, 15, 16, 24, 25; 404/40, 36, 28; 428/138; 52/669

(56) References Cited

U.S. PATENT DOCUMENTS

| | | | | | |
|---|---|---|---|---|---|
| 1,661,407 | A | * | 3/1928 | Butler | |
| 3,094,907 | A | * | 6/1963 | Hirst | 94/4 |
| 3,595,140 | A | * | 7/1971 | Lundin | 94/4 |
| 4,664,552 | A | * | 5/1987 | Schaaf | 405/20 |
| 5,282,692 | A | * | 2/1994 | McLeod | 404/35 |

* cited by examiner

*Primary Examiner*—Carl D. Friedman
*Assistant Examiner*—Basil Katcheves
(74) *Attorney, Agent, or Firm*—Gene W. Arant

(57) ABSTRACT

A weight strip constructed from a plurality of stacked sheets of elastomeric material slackly assembled for resting upon an uneven surface.

3 Claims, 3 Drawing Sheets

PORTABLE WEIGHT STRIP FOR ADJUSTABLY HOLDING A MEMBER IN POSITION ON AN UNEVEN SURFACE; AND METHOD

PRIORITY CLAIM

This application claims the benefit of my United States Provisional Application Ser. No. 60/208,000 filed May 26, 2000.

FIELD OF THE INVENTION

The field of this invention is convenience devices for placement on a substrate or member to thereby hold it in place.

PRIOR ART

United States Patents:

| | | |
|---|---|---|
| Kratz | 1,883,965 | 1932 |
| Fischer | 2,094,571 | 1937 |
| Schuyler | Re. 24,276 | 1957 |
| Schuyler | 3,063,399 | 1962 |
| Hirst | 3,094,907 | 1963 |
| Bergen | 3,096,973 | 1963 |
| Miller | 3,353,812 | 1967 |
| Graves | 3,862,876 | 1975 |
| Osborn | 4,682,447 | 1987 |

Hirst shows a mechanism for adjustably supporting a load above it. Bergen, Miller, and the Schuyler patents relate to shock absorbing bumpers for ships at loading docks. Graves and Osborn relate to holding down a tarpaulin.

BACKGROUND OF THE INVENTION

In agriculture it is sometimes necessary to fumigate a large area of soil. For that purpose an established practice is to place a tarpaulin over the area to be fumigated, and hold down the edges of the tarpaulin with whatever means are available in an effort to provide an effective gas seal for the area underneath.

In highway construction work it is common practice to employ portable signs that are supported upon the roadway to provide direction to travelers and workers. Since such signs have a large flat surface upon which the information is displayed, that same flat surface is necessarily exposed to the wind, which sometimes results in the sign being blown over.

SUMMARY OF THE INVENTION

My novel method of creating a hold-down weight against an uneven surface includes the steps of providing a plurality of sheets of elastomeric material each of which has at least one edge that is relatively straight, and which also has two openings a fixed distance apart; arranging the sheets into an elongated pile with the openings aligned; stringing a pair of cord-like members through the aligned openings; fastening the cord-like members with relatively low tension so that they are at least somewhat slack; and then laying the elongated pile upon the uneven surface such that the relatively straight edge of each sheet engages the uneven surface and a common transverse axis of the two openings of each sheet is at least generally parallel to the uneven surface.

My invention provides a novel weight strip including a plurality of substantially identical flat pad members each having a spaced pair of holes therethrough and each having a relatively straight support surface below the holes which is generally parallel to a common plane of the holes; a pair of cord-like members passing through the respectively corresponding holes in all of the pad members to arrange the pad members into a string; and securing means on the cord-like members to confine the pad members in a slack relationship so that when the support surfaces of various pad members of the weight strip are resting upon a substrate having an irregular surface the cord-like members may then bend to permit gaps to occur between some otherwise adjacent pad member edges.

According to the preferred form of my invention the flat pad members or sheets of elastomeric material are preferably cut from used automobile tires.

Thus the present invention provides a portable, economical, compact, relatively dull-edged weather resistant weight strip that is adaptable for use over uneven support surfaces.

DRAWING SUMMARY

DESCRIPTION OF PREFERRED EMBODIMENT (FIGS. 1 through 6)

Figure 1:
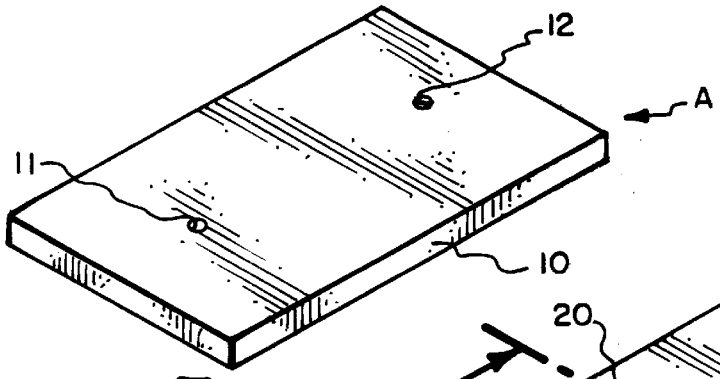
FIG. 1 is a perspective view of an individual elastomeric sheet or flat pad member in accordance with the preferred form of my invention.
Figure 2:
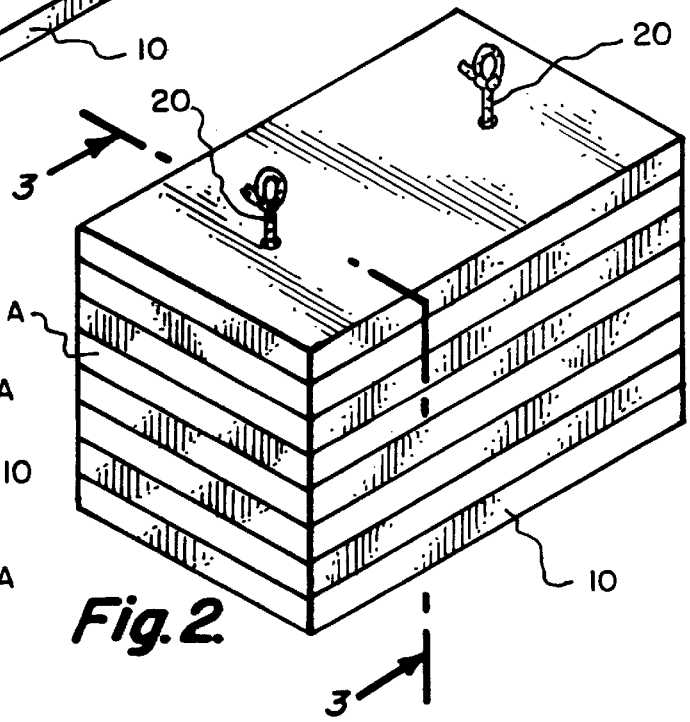
FIG. 2 shows a number of the pad members secured together to provide a weight strip in accordance with the invention.
Figure 3:
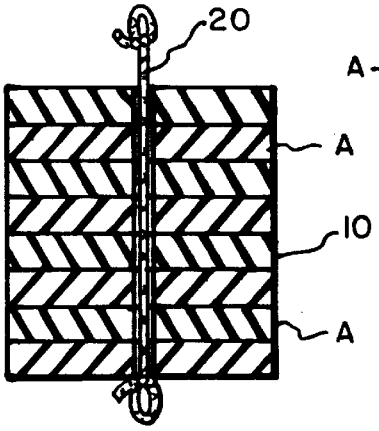
FIG. 3 is a vertical cross-section view taken on line 3—3 of FIG. 2 and showing one of the cords that sequentially tie the pad members together.

A large number of sheets A of elastomeric material, preferably but not necessarily identical in size and shape, are fastened together in a long string or weight strip S. The two cords 20 that hold the sheets together must be somewhat slack. As shown in FIG. 3, the cords may be sufficiently long that they extend somewhat beyond one end of the strip when all of the sheets or flat pad members are in tight face-to-face contact.

The cord-like members 20 are secured in a slack relationship. This may preferably be done by tying each cord at the corresponding end of the weight strip, but other methods of securing are also possible. For example, the cord ends may be tied or welded to the respective end pads of the pile, or attached at different points within the pile to provide the slack relationship. The purpose of the slack relationship is so that when the weight strip rests upon a substrate of irregular configuration with the support surfaces of its various pad members engaging different portions of the substrate, the weight strip may adapt itself to the irregular configuration of the substrate.

It is necessary for the sheets to have one side edge 10 that is at least relatively straight. The pair of holes 11, 12 cut through each pad member have a fixed separation distance and are in a common plane that is generally parallel to the resting edge 10. This makes it convenient to line up the sheets into the weight strip or pile and ensure that the resting edge 10 of all the sheets or pad members rest upon the substrate or ground or object that is to be held down.

Figure 7:
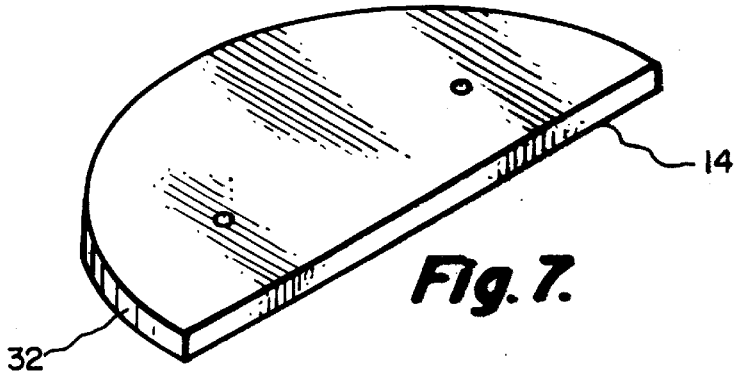
FIG. 7 is a perspective view of an alternate form of pad member in accordance with the invention.

In the preferred embodiment the sheets or pads are rectangular, as that shape is easy to cut from used rubber tires without waste of material. However, the shape of each sheet may for example be a half circle as shown in FIG. 7, or a quarter cirle, a triangle, or something else.

The method of use is as follows. A large number of sheets of elastomeric material which have one relatively straight edge and are of relatively similar size and shape are placed together in a stack. Each sheet has two openings 11, 12, and the openings have the same fixed spacing on all sheets so they can be conveniently strung together. Then, utilizing the aligned pairs of openings in the sheets, two cords 20 are sequentially threaded through the two sets of aligned openings to form the stack of sheets S and to hold the sheets together.

Figure 4:
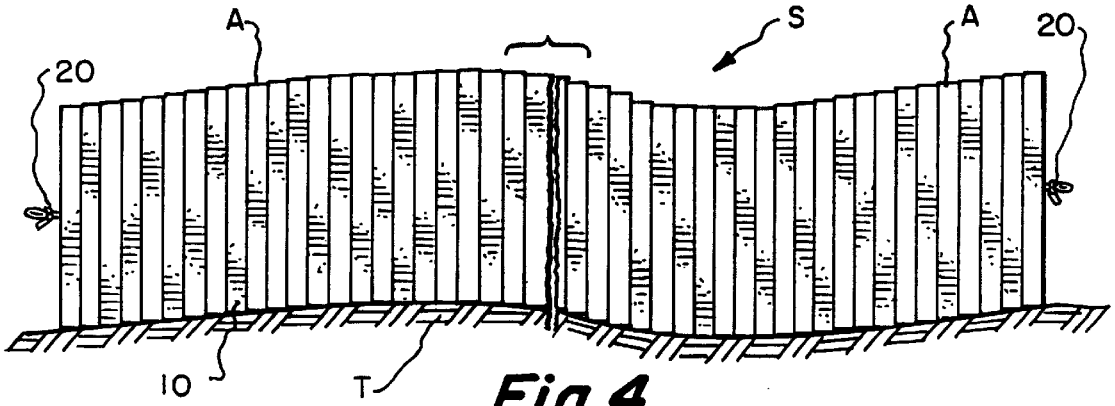
FIG. 4 is an elevation view showing a weight strip in accordance with the invention, resting upon an uneven substrate or surface.
Figure 5:
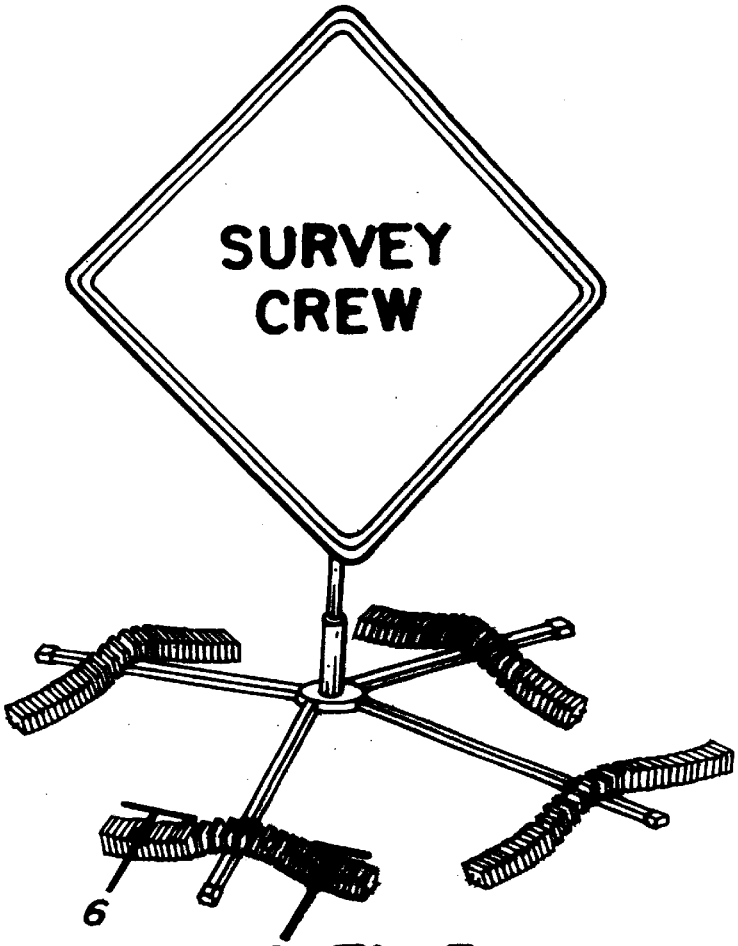
FIG. 5 is a perspective view of a portable highway sign upon a roadway that is being held in place by weight strips of the present invention on each of its four legs.
Figure 6:
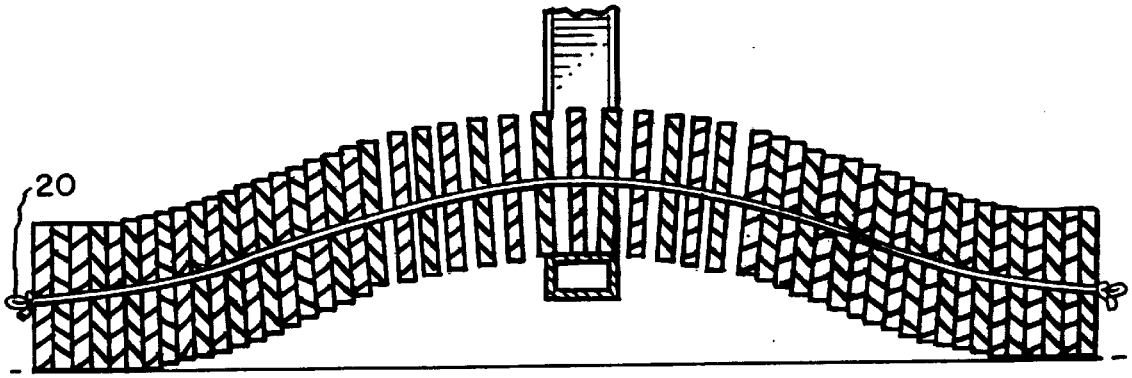
FIG. 6 is a cross-section view taken on line 6—6 of FIG. 5 and showing one of the weight strips holding one of the legs, the adaptation of the weight strip to the leg resulting in spaces between adjacent edges of some of the pad members that would otherwise be in face-to-face contact.

As shown in FIG. 4, the weight strip or stack may then be turned on its side, and rested upon an uneven surface T, which may be the edge of a tarpaulin that in turn rests upon the ground. As shown in FIG. 6, a weight strip extending over the leg of the sign results in some spaces occurring between adjacent edges of the pad members that would otherwise be in face-to-face contact. This necessarily involves some bending of the cord-like members 20.

ALTERNATE FORMS

As shown in FIG. 7, individual pad members may have a half circle configuration, the curved outer edge being designated as 32 and the straight resting edge as 14.

Figure 8:
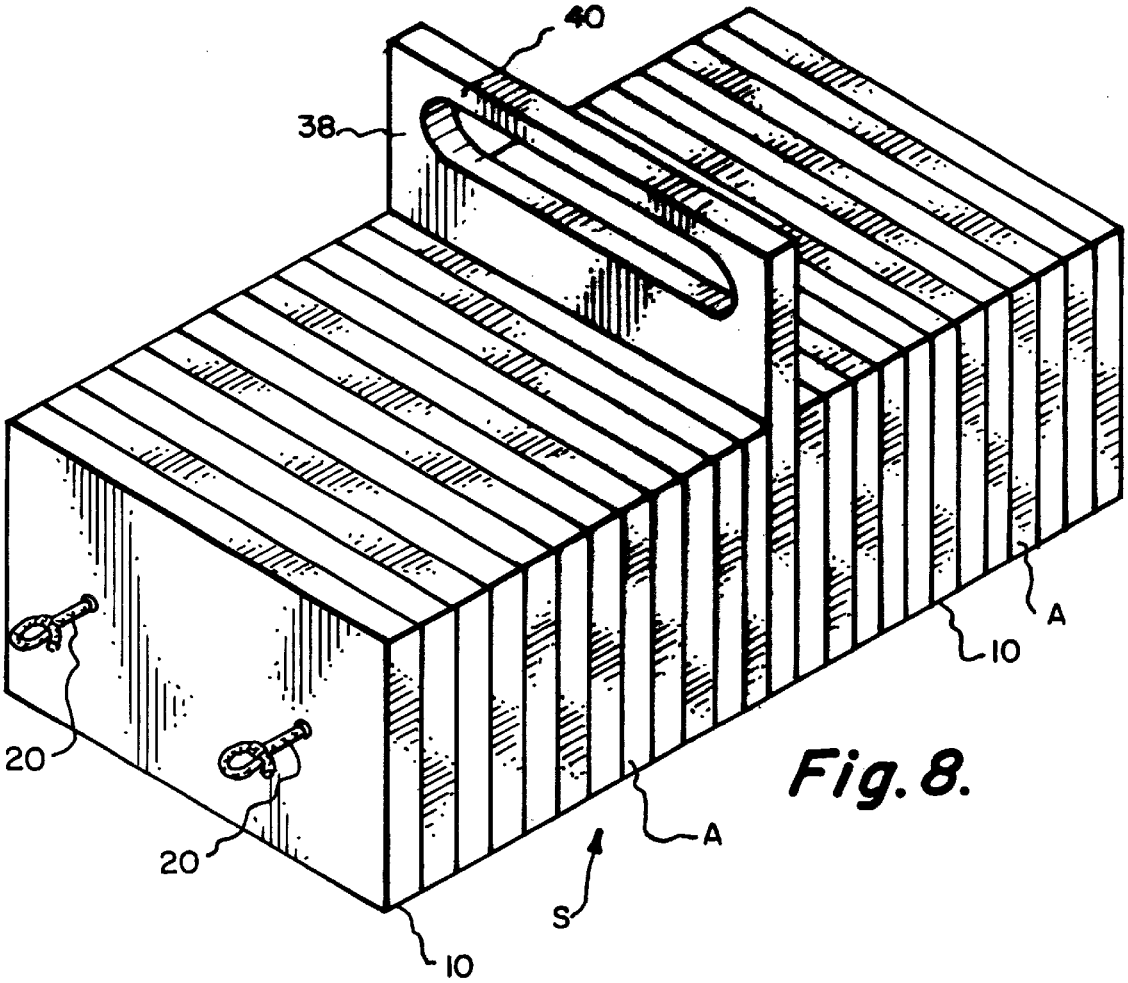
FIG. 8 is a perspective view of an alternative form of weight strip according to the invention.

As shown in FIG. 8, one of the pad members may be made with a protruding handle portion 38 with hand grip 40, which when placed in about the center of a weight strip provides a convenient method of holding or carrying it.

While many modifications will be apparent to those skilled in the art, the invention has been fully disclosed in its presently preferred form to fully comply with the requirements of the patent laws, and it should therefore be understood that the scope of the invention is to be judged only in accordance with the appended claims.

What I claim is:

1. A bendably adjustable weight strip comprising:

a plurality of flat sheets made from used vehicle tires, each sheet having a defined plane and having at least one side edge that is relatively straight to provide a resting edge which is generally perpendicular to its defined plane;

each sheet also having two openings perpendicular to the plane thereof that are substantially a fixed distance apart, the transverse axis of the two openings being at least generally parallel to the relatively straight side resting edge of the sheet;

the sheets being stacked together with their flat surfaces in a generally abutting engagement and with their defined planes generally parallel to each other to form an elongated pile in which the respective openings are essentially aligned;

a pair of cord-like members strung through respective ones of the aligned openings; and the ends of the cords being secured such that the cords are somewhat slack so that the elongated pile when laid upon an uneven surface with the defined planes of the flat sheets being essentially vertical and the relatively straight side resting edge of each individual sheet resting upon that surface may conveniently adjust itself to that surface, the resting edges of the sheets frictionally then engaging the uneven surface and the cords inside the strip bending as necessary in a vertical plane perpendicular to the resting edges to achieve that result.

2. The method of holding a member firmly upon the ground, comprising the steps of:

(a) cutting a plurality of flat pad members from discarded automobile tires, each pad member having a defined plane and also having a relatively straight side resting edge which is generally perpendicular to its defined plane;

(b) cutting through each pad member perpendicular to the plane thereof a pair of holes having a fixed separation distance and whose common plane is generally parallel to the side resting edge;

(c) arranging the pad members with their flat surfaces in generally abutting engagement and with their defined planes generally parallel to each other into a stack with corresponding openings aligned;

(d) passing a pair of flexible cord-like members sequentially through respective ones of the sets of aligned openings;

(e) securing the ends of the cord-like members to make a flexible weight strip, but leaving sufficient slack such that the weight strip when placed upon an uneven surface can bend in a vertical plane perpendicular to the resting edges of the pad members until spaces appear between pad member edges opposite to the resting edges that were otherwise in face-to-face contact; and (f) placing the weight strip over the member and upon the ground with the pad member side resting edges frictionally engaging the surfaces of both the member and the ground.

3. A bendably adjustable weight strip comprising:

a plurality of flat sheets made from used vehicle tires, each sheet having a defined plane and having at least one side edge that is made relatively straight to provide a resting edge which is generally perpendicular to its defined plane;

each sheet also having two openings perpendicular to the plane thereof that are substantially a fixed distance apart, the transverse axis of the two openings being at least generally parallel to the relatively straight side resting edge of the sheet;

the sheets being stacked together with their flat surfaces in a generally abutting engagement and with their defined planes generally parallel to each other to form an elongated pile in which the respective openings are essentially aligned;

a pair of cord-like members strung through respective ones of the aligned openings;

the ends of the cords being secured such that the cords are somewhat slack so that the elongated pile when laid upon an uneven surface with the defined planes of the flat sheets being essentially vertical and the relatively straight side resting edge of each individual sheet resting upon that surface may conveniently adjust itself to that surface; and one of the flat sheets at about the longitudinal center of the weight strip having a flat protruding handle portion with a hand grip, to provide a convenient means for holding the weight strip.

* * * * *